US005899215A

United States Patent [19]

Parker, III et al.

[11] Patent Number: 5,899,215

[45] Date of Patent: May 4, 1999

[54] DISHWASHER WITH RINSE DIVERTER FOR REDUCING DETERGENT CONSUMPTION

[75] Inventors: Carleton J. Parker, III, Greensboro, S.C.; Richard E. Bittner, St. Paul, Minn.; Mary J. Schumacher, Prior Lake, Minn.; Ralph J. Van Hoven, Woodbury, Minn.; Keith L. Ware, White Bear Lake, Minn.

[73] Assignee: Ecolab Inc., St. Paul, Minn.

[21] Appl. No.: 08/701,773

[22] Filed: Aug. 26, 1996

Related U.S. Application Data

[63] Continuation of application No. 08/639,362, Apr. 26, 1996, abandoned.

[51] Int. Cl.[6] ..... B08B 3/02

[52] U.S. Cl. ..... 134/25.2; 134/32; 134/72; 134/154; 134/182

[58] Field of Search ..... 134/60, 61, 182, 134/183, 155, 186, 154, 72, 32, 25.2, 68, 69, 70, 71, 26

[56] References Cited

U.S. PATENT DOCUMENTS

| | | | |
|---|---|---|---|
| 240,404 | 4/1881 | Gibbs | 134/60 |
| 1,311,496 | 7/1919 | Castellini | 134/60 |
| 1,664,637 | 4/1928 | Merseles et al. | 134/72 |
| 1,720,622 | 7/1929 | Breton | 134/60 |
| 1,943,775 | 1/1934 | Taylor | 134/60 |
| 2,133,481 | 10/1938 | Schroeder | 134/111 |
| 2,714,892 | 8/1955 | Mendenhall et al. | 134/72 |
| 2,770,242 | 11/1956 | Tubiolo | 134/72 |
| 2,949,120 | 8/1960 | Federighi et al. | 134/60 |
| 2,988,094 | 6/1961 | Ludwick et al. | 134/183 |
| 3,034,933 | 5/1962 | Richards | 134/60 |
| 3,337,896 | 8/1967 | Allen | 134/60 |
| 3,363,636 | 1/1968 | Weihe, Jr. . | |
| 3,601,144 | 8/1971 | Hansen . | |
| 3,698,407 | 10/1972 | Noren . | |
| 3,746,019 | 7/1973 | Hansen . | |
| 4,211,517 | 7/1980 | Schmid . | |
| 4,280,520 | 7/1981 | Fraula et al. . | |
| 4,561,471 | 12/1985 | Diaz . | |
| 4,648,140 | 3/1987 | Bogusz . | |
| 4,698,861 | 10/1987 | Bogusz . | |
| 4,805,649 | 2/1989 | Nezworski | 134/72 |
| 4,810,306 | 3/1989 | Noren . | |
| 4,872,466 | 10/1989 | Noren . | |
| 5,240,019 | 8/1993 | Rings . | |
| 5,564,159 | 10/1996 | Treiber | 134/72 |

FOREIGN PATENT DOCUMENTS

| | | | |
|---|---|---|---|
| 911121 | 7/1946 | France | 134/60 |
| 2322392 | 11/1974 | Germany | 134/60 |
| 2344146 | 3/1975 | Germany | 134/60 |
| 201031 | 4/1965 | Sweden | 134/60 |
| 1269604 | 7/1985 | U.S.S.R. | 134/72 |

OTHER PUBLICATIONS

Champion Rack Conveyor Dishwasher product literature, pp. 5–6.

Hobart C–44A Dishwasher product literature (1990).

Hobart Catalog of Replacement Parts, Model C44A Series Dishwashers, Form 17820 (Nov.–1989), p.22.

*Primary Examiner*—Frankie L. Stinson

*Attorney, Agent, or Firm*—Merchant, Gould, Smith, Edell, Welter & Schmidt, P.A.

[57] ABSTRACT

A diverter member is installed in a dishwasher to reduce detergent consumption therein. The diverter member includes an upwardly disposed liquid receiving surface in fluid communication with a drain for receiving a portion of the rinse liquid sprayed on dishware in a rinse section of the dishwasher to increase the amount of rinse liquid communicated to the drain. A lesser amount of rinse liquid returns to the wash tank, thereby reducing dilution of the wash liquid and consumption of detergent.

19 Claims, 4 Drawing Sheets

200
211
220
221
225
225
214
218
219
219

200
211
225
225
230
231
231
232
214
218
219
219

DISHWASHER WITH RINSE DIVERTER FOR REDUCING DETERGENT CONSUMPTION

This is a continuation of U.S. patent application Ser. No. 08/639,362, filed on Apr. 26, 1996, now abandoned.

FIELD OF THE INVENTION

The invention is related to dishwashers having separate rinse and wash sections which recycle rinse and/or wash liquid to reduce water consumption. More particularly, the invention is related to reducing detergent consumption in such dishwashers.

BACKGROUND OF THE INVENTION

Dishwashers (or warewashers), particularly of the commercial variety, often include water-saving features to reduce water and energy consumption.

As an example, the Model C-44A series dishwashers available from Hobart Corporation include a wash tank divided into wash and rinse sections and housing a wash liquid (typically detergent charged water). Spray arms are disposed within each of the wash and rinse sections to spray wash liquid and rinse liquid (typically water), respectively, onto dishware. The sections are typically divided by a curtain and a divider plate to contain sprayed liquid within each section, although a space is typically provided below the divider plate to allow for the flow of liquid between the two sections of the wash tank. A conveyor system moves dishware between the sections.

All or most of the wash liquid sprayed on dishware within the wash section drains back into the wash tank to be reused. In addition, most of the rinse liquid sprayed on dishware within the rinse section also flows back into the wash tank and mixes with the wash liquid. However, a small rinse catch pan (about 50 to 80 square inches) is disposed within the rinse section to divert a portion of the rinse liquid to the drain.

While this system of returning a majority of the rinse liquid to the wash tank reduces overall water consumption, a greater concern is raised as to the consumption of detergent. In particular, the concentration of detergent in the wash liquid must be carefully controlled to provide optimum cleaning. However, the addition of rinse liquid has the effect of diluting the concentration of detergent in the wash liquid, thereby reducing the performance of the machine. Moreover, additional detergent must be added to the wash liquid (typically by an automatic closed-loop system) to maintain the proper concentration. As a result, it has been found that an excessive amount of detergent is used in these machines.

Over-use of detergent increases operating costs, as well as poses environmental concerns. Over-use of detergent also does not improve cleaning performance. Therefore, a substantial need has arisen for a manner of reducing detergent consumption in dishwashers and the like, while maintaining optimum dishwasher performance.

SUMMARY OF THE INVENTION

The invention addresses these and other problems associated with the prior art by utilizing a diverter member having an upwardly disposed liquid receiving surface in fluid communication with a drain for receiving a portion of the rinse liquid sprayed on dishware such that a greater portion of rinse liquid is communicated to the drain, thereby reducing the amount of rinse liquid mixed with the wash liquid. It has been found that by reducing the amount of rinse liquid mixed with the wash liquid, dilution of the wash liquid is minimized and less detergent is used.

Therefore, in accordance with one aspect of the invention, an apparatus is provided for reducing detergent consumption in a dishwasher of the type which houses a wash liquid charged with detergent, and which rinses dishware with a rinse liquid, wherein a first portion of the rinse liquid is recycled and mixed with the wash liquid and a second portion of the rinse liquid is communicated to a drain. The apparatus includes a diverter member disposed within the dishwasher and having an upwardly disposed liquid receiving surface in fluid communication with the drain for receiving a portion of the rinse liquid such that a greater portion of rinse liquid is communicated to the drain, thereby reducing the amount of rinse liquid mixed with the wash liquid.

In accordance with another aspect of the invention, there is provided a dishwasher for washing dishes, which includes a wash tank housing a wash liquid having a concentration of detergent; a divider plate disposed within the wash tank and separating the wash tank into wash and rinse sections; a first spray arm oriented to spray dishes with the wash liquid when the dishes are located within the wash section of the wash tank; a second spray arm oriented to spray dishes with a rinse liquid when the dishes are located within the rinse section of the wash tank; a rinse catch pan disposed within the rinse section of the wash tank and oriented to divert a portion of the rinse liquid sprayed on dishes to a drain, wherein a remaining portion of the rinse liquid sprayed on dishes is returned to the wash tank and mixed with the wash liquid; and a diverter member disposed within the wash tank dishwasher and having an upwardly disposed liquid receiving surface in fluid communication with the drain for receiving a portion of the rinse liquid such that a greater portion of rinse liquid is communicated to the drain, thereby reducing the amount of rinse liquid mixed with the wash liquid.

According to a further aspect of the invention, a method is provided for reducing detergent consumption in a dishwasher of the type which houses a wash liquid charged with detergent, and which rinses dishware with a rinse liquid, wherein a first portion of the rinse liquid is recycled and mixed with the wash liquid and a second portion of the rinse liquid is communicated to a drain. The method includes the step of installing a diverter member in the dishwasher, the diverter member having an upwardly disposed liquid receiving surface in fluid communication with the drain for receiving a portion of the rinse liquid such that a greater portion of rinse liquid is communicated to the drain, thereby reducing the amount of rinse liquid mixed with the wash liquid.

These and other advantages and features, which characterize the invention, are set forth in the claims annexed hereto and forming a further part hereof. However, for a better understanding of the invention, and the advantages and objectives attained by its use, reference should be made to the Drawing, and to the accompanying descriptive matter, in which there is described preferred embodiments of the invention.

DETAILED DESCRIPTION OF THE PREFERRED EMBODIMENT

Figure 1:
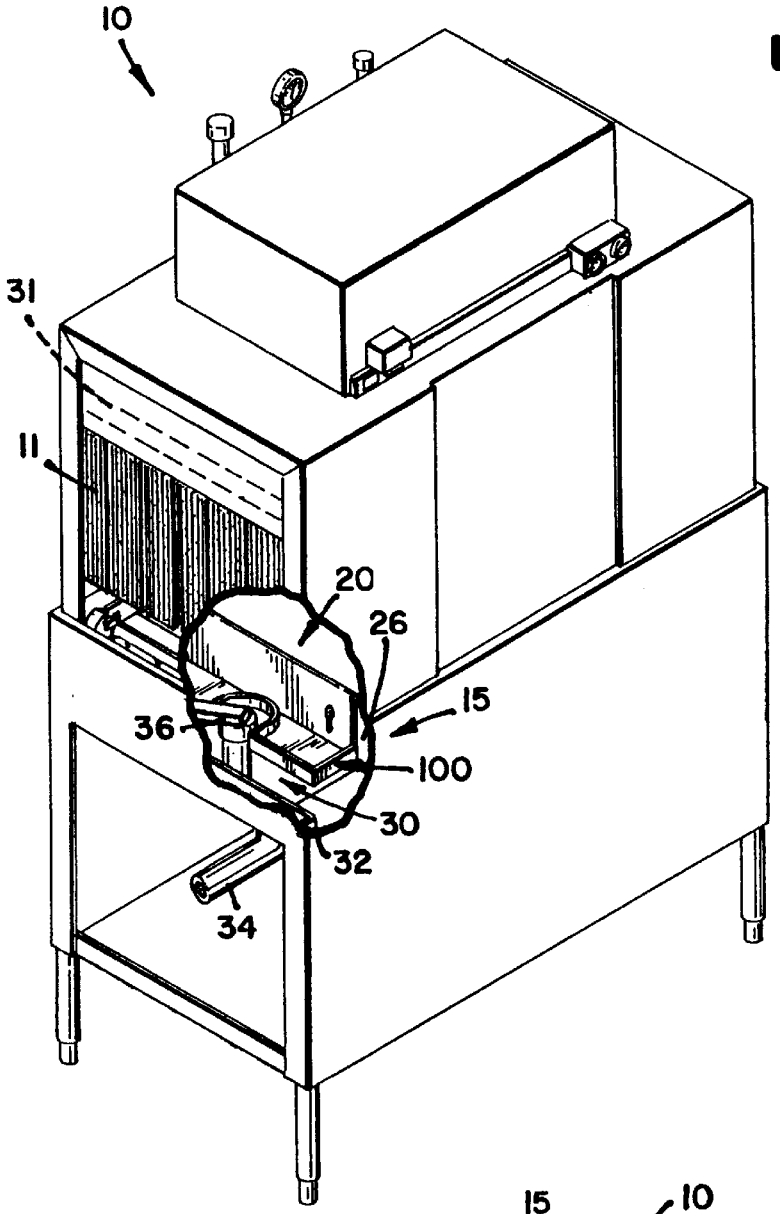
FIG. 1 is a perspective view of a dishwasher utilizing a preferred diverter member consistent with the principles of the invention, with portions thereof cut away.

Turning to the Drawing, wherein like numbers denote like parts throughout the several views, FIG. 1 shows a dishwasher 10 within which is installed a preferred diverter member 100 consistent with the principles of the invention. Dishwasher 10 includes a wash tank 15 which is separated into a wash section 20 and a rinse section 30.

Dishwasher 10 is preferably a commercial conveyor-type dishwasher, e.g., a Model C-44A series dishwashers available from Hobart Corporation. However, it should be appreciated that the preferred embodiments of the invention may be utilized on numerous other dishwashers, e.g., the rack conveyor dishwasher available from Champion, and the Hobart C-44 dishwasher, among others. In general, it should be appreciated that the preferred embodiments disclosed herein are optimized for use in one particular make and mode of dishwasher; however, as different dishwashers will vary in construction and detail, the invention should not be limited to any particular dishwasher design.

Figure 2:
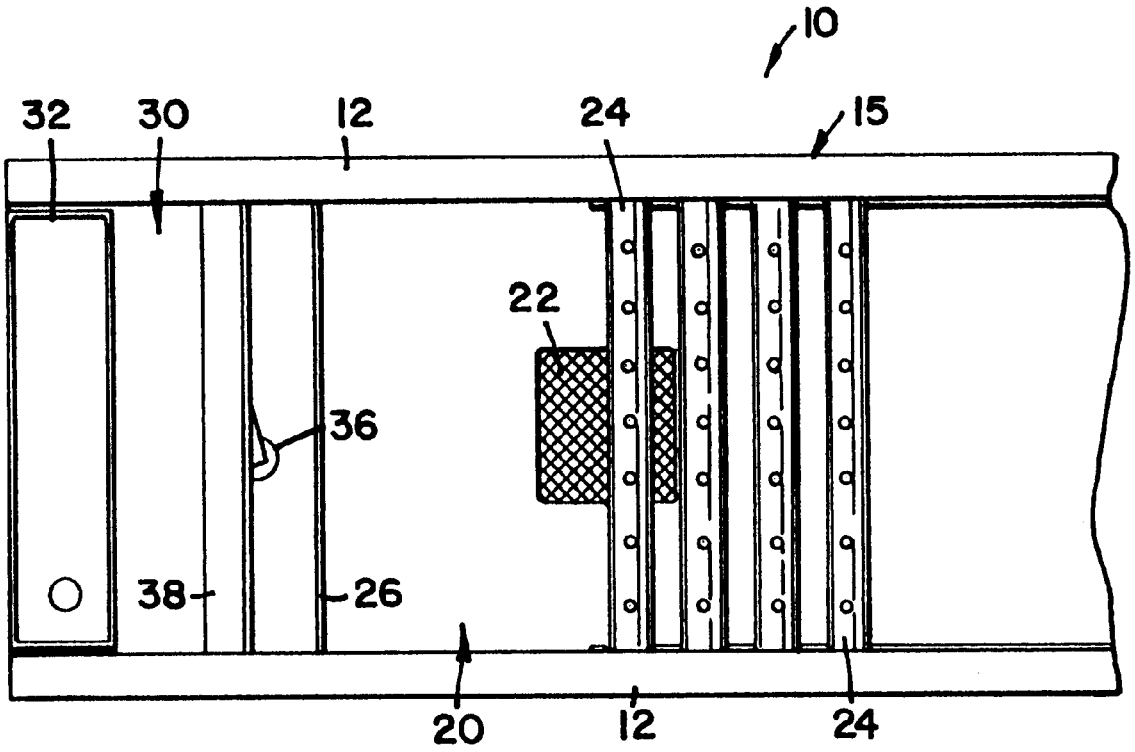
FIG. 2 is a top plan view of a portion of the wash tank in the dishwasher of FIG. 1.

As shown in FIGS. 1 and 2, dishwasher 10 includes a wash tank 15 that is separated into a wash section 20 and a rinse section 30 by a divider plate 26. A space is typically provided underneath divider plate 26 to permit the flow of liquid between the two sections. The purpose of divider plate 26 is primarily to prevent spray and splashing between the sections. In addition, flexible curtains are typically disposed above the divider plate to further assist in this function.

Wash section 20 includes a sump 22 within which a pump and concentration sensor are located. A wash liquid, typically detergent charged water, is housed in the sump. Other chemicals, e.g., sanitizers, rinse aids, water softeners, etc. may also be present in the wash liquid. The wash liquid is directed upward onto a rack of dishware (not shown) through one or more wash spray arms 24. Another set of wash spray arms is typically disposed above the wash tank to direct wash liquid downward onto dishware.

Racks are conveyed from wash section 20 to rinse section 30 by a conveyor system having conveyor guides 12 and an activator arm 38 that is driven in a reciprocating manner by a conveyor drive 36.

The rinse section 30 includes upper and lower rinse spray arms (e.g., upper spray arm 31) for spraying a rinse liquid on the dishware. The rinse liquid is typically water, although additives such as rinse aids, water softeners, etc. may also be present. Outer curtains 11 minimize splashing and spray from exiting the dishwasher. A rinse catch pan 32 having a drain 34 is disposed within the rinse section, and has an upwardly disposed opening which is oriented to divert a portion of the rinse liquid that is sprayed on the dishware to the drain.

The amount of rinse liquid which is diverted to the drain is generally a function of the relative surface area of the opening of the rinse catch pan compared to the overall area of the rinse section of the wash tank. The rinse catch pan used in the dishwasher of the preferred embodiment typically has an effective liquid receiving area of about 60 to 135 square inches. The effective area of the overall rinse section is about 200 to 300 square inches. It has been found about 300 to 800 milliliters of rinse liquid is typically diverted to the drain in a 15 second cycle, which represents only about 6 to 16% of the overall amount of rinse liquid supplied in a 15 second cycle (typically about 4600 to 5100 milliliters). It should be appreciated that the correspondence between area and amount of rinse liquid diverted may not be purely proportional because of factors such as the amount of spray exiting the dishwasher or returning to the wash section through the curtains, the amount of rinse liquid retained by the dishware and the rack, etc.

The preferred embodiments of the invention operate by increasing the amount of rinse liquid diverted to the drain to reduce dilution of the wash tank and the resulting increase in detergent consumption. This is accomplished principally by orienting an upwardly disposed liquid receiving surface in fluid communication with the drain to increase the effective liquid receiving area of the rinse catch pan or similar structure.

Figure 3:
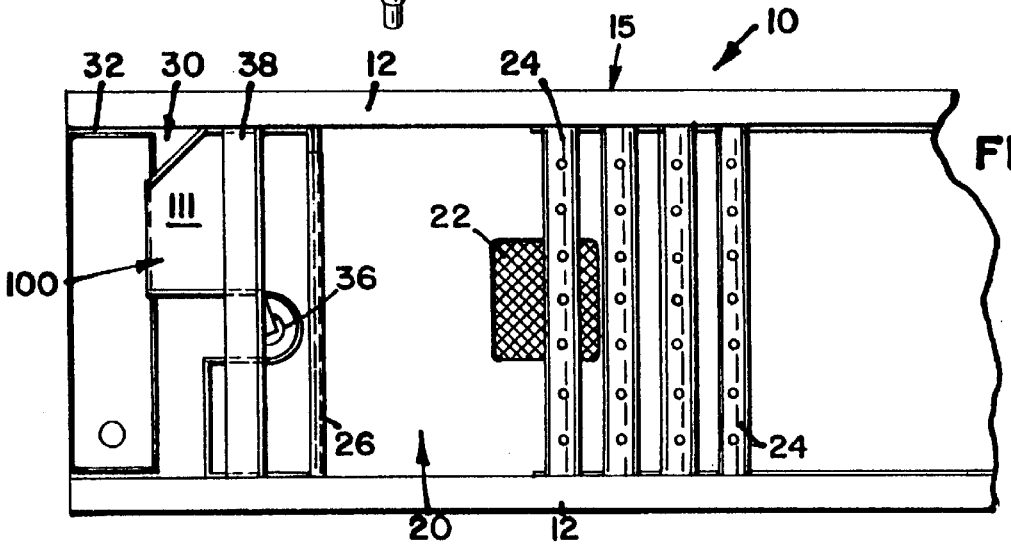
FIG. 3 is a top plan view of the wash tank of FIG. 2, with the preferred diverter member installed therein.

As shown in FIG. 3, one preferred manner of increasing the effective area is through installing a diverter member 100 which spans between divider plate 26 and rinse catch pan 32 and provides an upwardly disposed liquid receiving surface 111. The preferred diverter member 100, shown in greater detail in FIG. 4, preferably includes a liquid receiving member 110 coupled to a support member 130.

Member 110 defines the liquid receiving surface 111 and includes left and right sections 112, 118 separated by a cut-out or narrowed section 116. A side wall 114 extends around the perimeter of member 110 to form a pan to catch the rinse liquid. A downwardly extending lip 120 in left section 112 supports member 110 on rinse catch pan 32 and provides the only opening in the wall to permit rinse liquid to drain into the catch pan. Lip 120 preferably hangs over the edge of the rinse catch pan, and a plurality of teeth 122 cut into the lip engage the rinse catch pan to restrict movement of diverter member 100.

Cut-out section 116 is designed in member 110 to fit around the conveyor drive 36 without obstructing the operation thereof. In addition, right section 118 preferably does not extend all the way to the rinse catch pan, as it has been found that the single lip 120 is often sufficient to communicate all of the liquid retained by the diverter member to the rinse catch pan. In the alternative, a separate downwardly extended lip may be provided to drain liquid from this section into the rinse catch pan.

Figure 5:
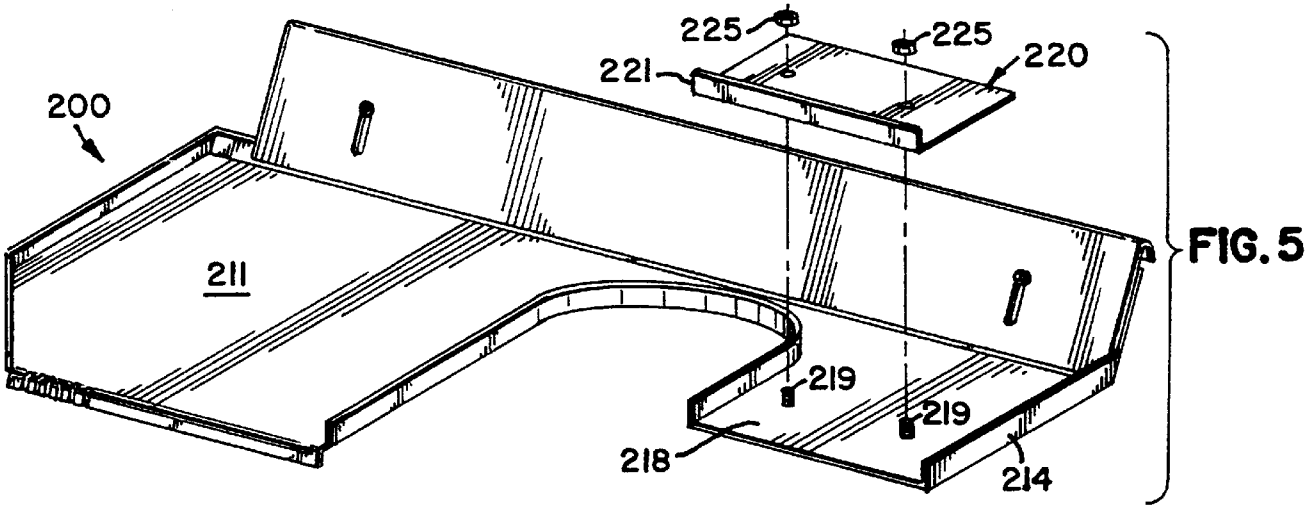
FIG. 5 is an exploded perspective view of an alternate diverter member to that of FIG. 4, shown with a removable plate suitable for use therewith.
Figure 6:
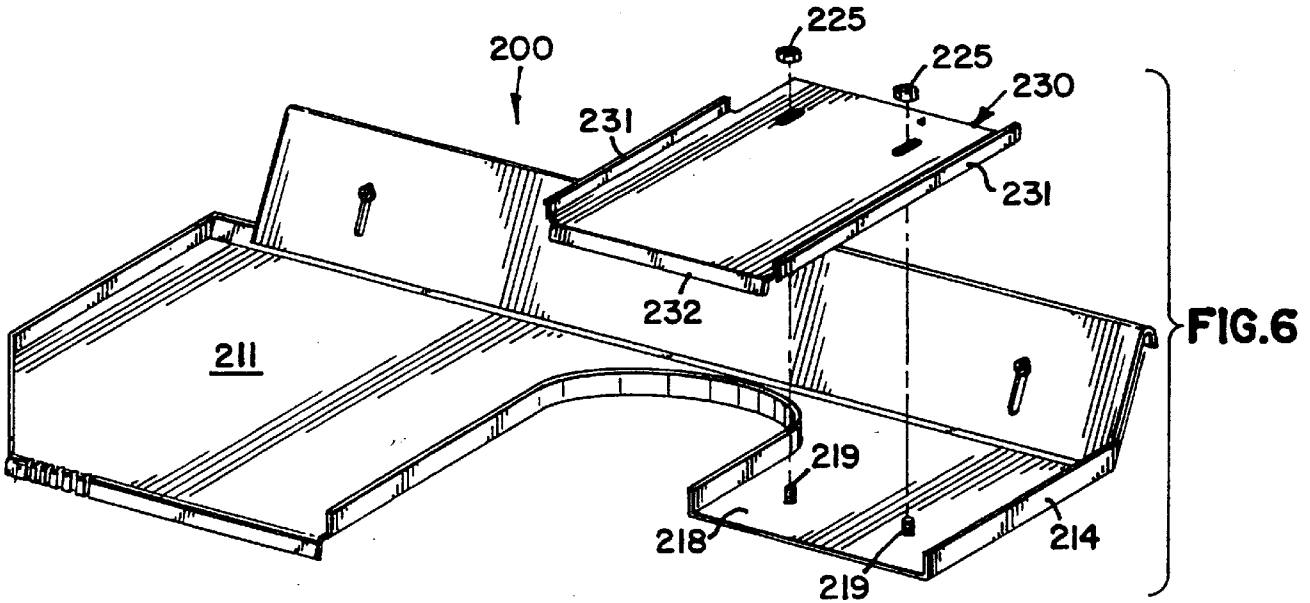
FIG. 6 is an exploded perspective view of the diverter member of FIG. 5, shown with an alternate removable plate suitable for use therewith.

As another alternative, FIG. 5 illustrates a diverter member 200 with a liquid receiving surface 211 having a right portion 218. Right portion 218 includes a pair of threaded posts 219, as well as a break in side wall 214. A first adapter plate 220 may be removably secured to member 200 by fasteners 225 with a side wall 221 that traps water in cooperation with side wall 214, similar in operation to diverter member 100. Moreover, as shown in FIG. 6, a second adapter plate 230 may also be secured to member 200 such that right portion 218 spans the distance between the divider plate and the rinse catch pan. Side walls 231 on plate 230 extend side wall 214, while a lip 232 overlaps the rinse catch pan. Consequently, it should be appreciated that the diverter member may be adaptable for use in multiple dishwashers or applications, or may be adaptable for selectively diverting different amounts of liquid to the rinse catch pan.

Returning to FIG. 4, member 110 preferably includes a back plate 124 having threaded posts that project through vertically oriented slots 136 in support member 130. Nuts 126 thread onto the threaded posts to secure members 110 and 130 together. Support member 130 also includes a lip 132 which supports diverter member 100 on divider plate 26. The slots in member 130 permit the height of the diverter member to be adjusted so that the member is suspended properly between divider plate 126 and rinse catch pan 132.

Liquid receiving surface 111 is preferably inclined downward from horizontal toward the rinse catch pan at an angle of about 13 to 17°, more preferably about 15°, such that any liquid received by the surface will flow to the rinse catch pan. It may also be desirable to incline surface 111 transversely (i.e., with right portion 118 higher than left portion 112), so that any liquid received on the right portion will also flow ultimately to the rinse catch pan.

Figure 4:
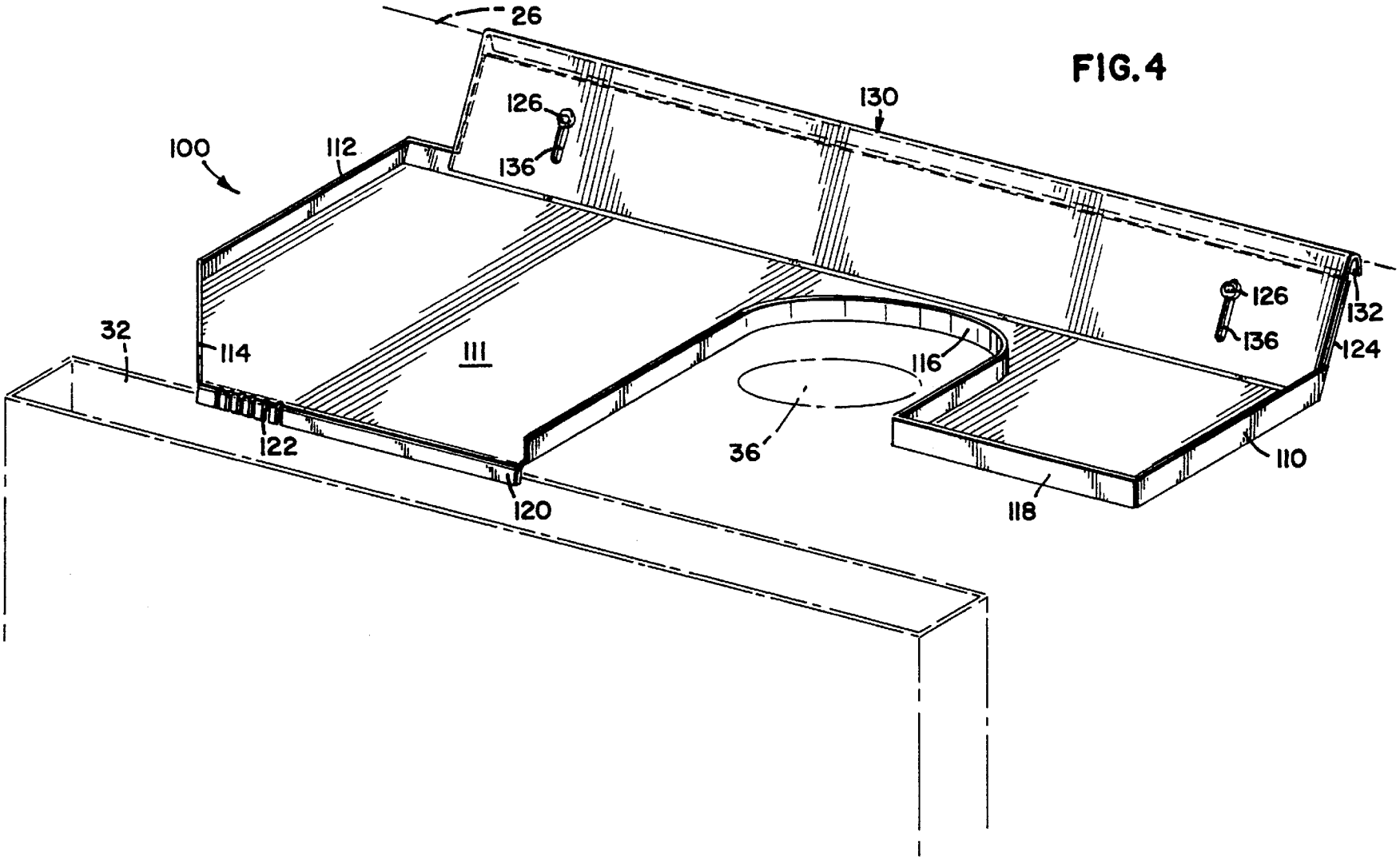
FIG. 4 is a perspective view of the preferred diverter member of FIG. 1, with a rinse catch pan shown in phantom.

It should be appreciated in general that the particular structure of the diverter member may vary greatly depending upon the surrounding structure and space available within a particular dishwasher. The preferred 5 structure shown in FIG. 4 is optimized for use with the aforementioned Hobart dishwasher; however, for other dishwashers vastly different structures may be required.

Preferably, the liquid receiving surface has an area of about 40 to 65 percent of the area of the rinse section of the dishwasher. It has been found that with the preferred diverter member, about 2,000 to 2,500 milliliters of rinse liquid is diverted to the drain in a typical 15 second rinse cycle, thereby reducing the portion of rinse liquid returned to the wash tank to about 35 to 55%. More importantly, however, it has been found that detergent usage is reduced at least 20% by virtue of the reduced amount of rinse liquid returned to the wash tank. No corresponding decrease in dishwasher performance, however, accompanies the reduced detergent consumption.

One advantage of the preferred diverter member is that it may be installed into an existing dishwasher quickly, easily, and with little or no modification to the system. Installation is simply a matter of sliding the diverter member around the surrounding structure until it hangs off of the divider plate and rinse catch pan. Of course, in other dishwashers, the diverter member may be supported by other structure in the dishwasher consistent with the invention. Moreover, other manners of communicating liquid from the liquid receiving surface to the drain may be used, e.g., a hose or conduit leading from the liquid receiving surface to a catch pan or directly to the drain. This could eliminate the need for the diverter member to drain into a rinse catch pan, e.g., in dishwashers without a pan.

It should also be appreciated that different detergents may have different optimum wash tank concentrations, and thus may have different optimum rinse liquid recycle rates in a dishwasher. The preferred diverter members may be used to optimize a particular dishwasher for use with different detergents, simply by using a suitably sized and shaped diverter member that provides the optimum recycle rate. Therefore, consistent with the invention, the preferred embodiments permit a dishwasher to be optimized for use with a particular detergent easily, inexpensively, and without substantial modification to the dishwasher.

Various modifications may be made to the preferred embodiments without departing from the spirit and scope of the invention. For example, the diverter member may be constructed from a single component. In addition, the member may be constructed with removable plates and/or covers so that a single design may be customizable for different models of dishwashers. The plates and covers may be secured via fasteners or snap-fit tabs, may be removable via score lines formed in the diverter member, or in other manners known in the art.

Furthermore, instead of hanging from components in the dishwasher, the diverter member may be secured by fasteners or other mechanisms to other structures on a dishwasher. In addition, while the preferred diverter member is constructed of stainless steel, other metals, plastics, or other materials may be used in the alternative. Other modifications will be appreciated by one skilled in the art.

As other modifications to the preferred embodiments will be appreciated by one skilled in the art, the invention therefore lies in the claims hereinafter appended.

What is claimed is:

1. An apparatus for reducing detergent consumption in a dishwasher of the type which houses a wash liquid charged with detergent, and which rinses dishware with a rinse liquid, wherein a first portion of the rinse liquid is recycled and mixed with the wash liquid and a second portion of the rinse liquid is communicated to a drain, the apparatus comprising a diverter member disposed within the dishwasher and having an upwardly disposed liquid receiving surface in fluid communication with the drain for receiving a portion of the rinse liquid such that a greater portion of rinse liquid is directly communicated to the drain, thereby reducing the amount of rinse liquid mixed with the wash liquid wherein diverting rinse liquid to the drain reduces dilution of the wash tank and the resulting increase in detergent consumption.

2. The apparatus of claim 1, wherein the dishwasher includes a divider plate separating wash and rinse sections of the dishwasher and a catch pan for communicating the second portion of the rinse liquid to the drain, and wherein the diverter member includes a pair of opposing lips for supporting the diverter member between the divider plate and the rinse catch pan such that rinse liquid received on the liquid receiving surface flows into the rinse catch pan.

3. The apparatus of claim 2, wherein the liquid receiving surface is disposed on a liquid receiving member having a side wall defined about a perimeter thereof for retaining rinse liquid, and wherein the lip supporting the diverter member on the rinse catch pan defines an opening in the side wall.

4. The apparatus of claim 3, wherein the lip supporting the diverter member on the rinse catch pan includes a plurality of teeth engaging the rinse catch pan.

5. The apparatus of claim 3, wherein the dishwasher includes a conveyor drive, and wherein the liquid receiving member includes a cut-out section having an aperture oriented to receive the conveyor drive; whereby the cut-out section partially circumscribes the conveyor drive without inhibiting the operation thereof.

6. The apparatus of claim 3, wherein the liquid receiving member includes a back plate with a plurality of threaded posts secured thereto, and wherein the diverter member further includes:

(a) a support member having the lip supporting the diverter member on the divider plate and a plurality of vertically oriented slots receiving the plurality of threaded posts; and (b) a plurality of threaded fasteners engaging the plurality of threaded posts; whereby the support member may be secured to the liquid receiving member at a plurality of positions.

7. The apparatus of claim 2, wherein the liquid receiving surface is inclined toward the rinse catch pan at an angle of between about 13 and 17 degrees.

8. The apparatus of claim 2, wherein the liquid receiving surface has an area of about 40 to 65 percent of the area of the rinse section of the dishwasher.

9. A dishwasher for washing dishes, comprising:

(a) a wash tank housing a wash liquid having a concentration of detergent;

(b) a divider plate disposed within the wash tank and separating the wash tank into wash and rinse sections;

(c) a first spray arm oriented to spray dishes with the wash liquid when the dishes are located within the wash section of the wash tank;

(d) a second spray arm oriented to spray dishes with a rinse liquid when the dishes are located within the rinse section of the wash tank;

(e) a rinse catch pan disposed within the rinse section of the wash tank and oriented to divert a portion of the rinse liquid sprayed on dishes to a drain, wherein a remaining portion of the rinse liquid sprayed on dishes is returned to the wash tank and mixed with the wash liquid; and (f) a diverter member disposed within the wash tank dishwasher and having an upwardly disposed liquid receiving surface in fluid communication with the drain for receiving a portion of the rinse liquid such that a greater portion of rinse liquid is directly communicated to the drain, thereby reducing the amount of rinse liquid mixed with the wash liquid wherein diverting rinse liquid to the drain reduces dilution of the wash tank and the resulting increase in detergent consumption.

10. The dishwasher of claim 9, wherein the liquid receiving surface is disposed on a liquid receiving member including a downwardly extending lip supporting the diverter member on the rinse catch pan and a side wall defined about a perimeter of the liquid receiving member for retaining rinse liquid, and wherein the lip supporting the diverter member on the rinse catch pan defines an opening in the side wall to communicate rinse fluid to the rinse catch pan.

11. The dishwasher of claim 10, wherein the diverter member further comprises an adaptor plate removably coupled to the liquid receiving member.

12. The dishwasher of claim 10, further comprising an upwardly projecting conveyor drive disposed in the rinse section of the wash tank, and wherein the liquid receiving member includes a cut-out section having an aperture oriented to receive the conveyor drive; whereby the cut-out section partially circumscribes the conveyor drive without inhibiting the operation thereof.

13. The dishwasher of claim 10, wherein the liquid receiving member includes a back plate with a plurality of threaded posts secured thereto, and wherein the diverter member further includes:

(a) a support member having a lip supporting the diverter member on the divider plate and a plurality of vertically oriented slots receiving the plurality of threaded posts; and (b) a plurality of threaded fasteners engaging the plurality of threaded posts; whereby the support member may be secured to the liquid receiving member at a plurality of positions.

14. The dishwasher of claim 9, wherein the liquid receiving surface is inclined toward the rinse catch pan at an angle of between about 13 and 17 degrees.

15. The dishwasher of claim 9, wherein the liquid receiving surface has an area of about 40 to 65 percent of the area of the rinse section of the dishwasher.

16. A method of reducing detergent consumption in a dishwasher of the type which houses a wash liquid charged with detergent, and which rinses dishware with a rinse liquid, wherein a first portion of the rinse liquid is recycled and mixed with the wash liquid and a second portion of the rinse liquid is communicated to a drain, the method comprising the step of:

(a) installing a diverter member in the dishwasher, the diverter member having an upwardly disposed liquid receiving surface in fluid communication with the drain for receiving a portion of the rinse liquid such that a greater portion of rinse liquid is directly communicated to the drain, thereby reducing the amount of rinse liquid mixed with the wash liquid wherein diverting rinse liquid to the drain reduces dilution of the wash tank and the resulting increase in detergent consumption.

17. The method of claim 16, wherein the installing step includes the step of supporting the diverter member between a divider plate and a rinse catch pan in the dishwasher.

18. The method of claim 16, further comprising the step of sizing the liquid receiving surface to be an area of about 40 to 65 percent of the area of a rinse section of the dishwasher.

19. The method of claim 16, further comprising the step of diverting about 45 to 65 percent of the rinse liquid to the drain.

* * * * *